United States Patent [19]

Loeffler

[11] Patent Number: 4,781,043

[45] Date of Patent: Nov. 1, 1988

[54] SECURITY SHIELD FOR PROTECTION OF A PADLOCK

[76] Inventor: Charles P. Loeffler, 5573 Peacock La., Riverside, Calif. 92505

[21] Appl. No.: 124,166

[22] Filed: Nov. 23, 1987

[51] Int. Cl.[4] ..... E05B 67/38

[52] U.S. Cl. ..... 70/54; 70/417

[58] Field of Search ..... 70/54, 55, 56, 33, 18, 70/14, 417

[56] References Cited

U.S. PATENT DOCUMENTS

| | | |
|---|---|---|
| 2,541,638 | 2/1951 | Clevett . |
| 3,783,657 | 1/1974 | Foote . |
| 3,828,591 | 8/1974 | Beaver . |
| 4,122,693 | 10/1978 | Barr . |
| 4,238,941 | 12/1980 | Halopoff . |
| 4,506,528 | 3/1985 | Eberly . |
| 4,566,296 | 1/1986 | Kochekis . |
| 4,567,740 | 2/1986 | Kelly . |

*Primary Examiner*—Robert L. Wolfe

*Attorney, Agent, or Firm*—Harvey S. Hertz

[57] ABSTRACT

A security shield for protection of a padlock of a type which has a body and shackle. The shackle is of generally U-shaped configuration and has a free leg and a pivoting captive leg interconnected by an outer end. The security shield comprises a housing and a saddle positioned therein. The housing has a front and rear wall interconnected by a pair of side walls. A top wall interconnects the ends of the front, rear and side walls to define an open ended box. The front wall has a locking port formed therein for enabling a hasp to pass therethrough and an exit slot formed in the top wall for enabling a shackle outer end to pass therethrough. The saddle is secured to the interior of the housing and comprises a lower horizontal base and a upper horizontal base interconnected by a vertical arm. The bases each have apertures therein for enabling the shackle free leg to pass therethrough. A shackle support element extends upwardly from the upper horizontal base for positioning the shackle with respect to the housing when the padlock is in a closed position.

4 Claims, 2 Drawing Sheets

FIG. 1
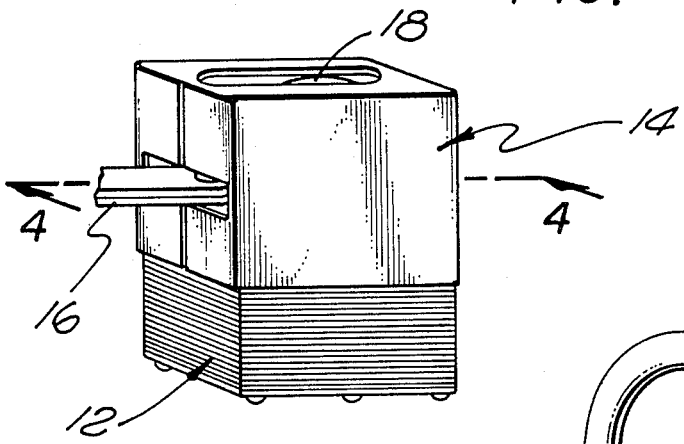
FIG. 2
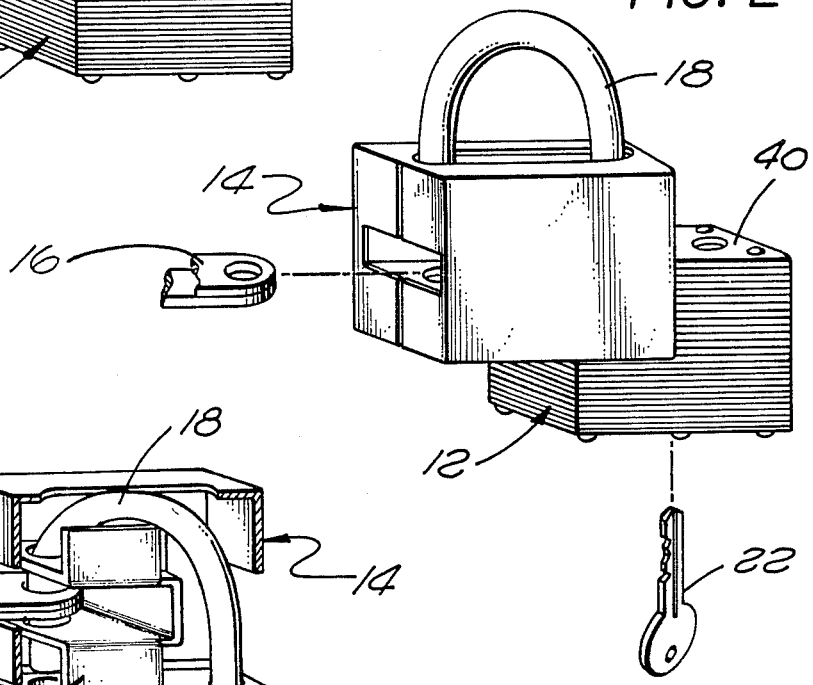
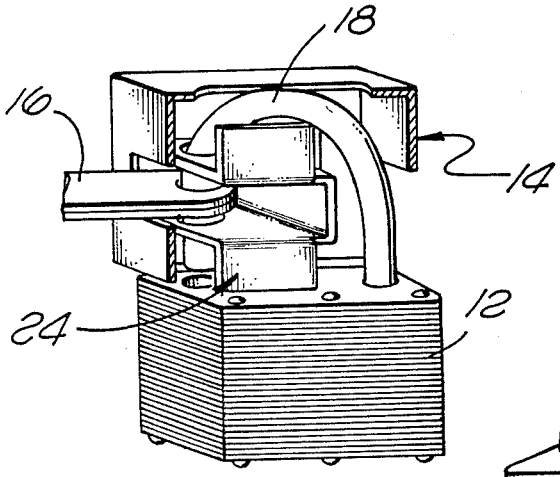
FIG. 4
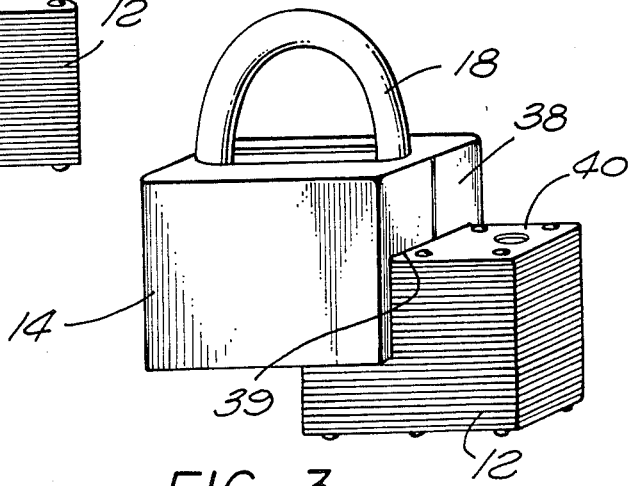
FIG. 3

SECURITY SHIELD FOR PROTECTION OF A PADLOCK

BACKGROUND OF THE INVENTION (1) Field Of The Invention

The field of right to which the invention pertains include the field of padlock security shields, and more particularly, to a security shield which minimizes the opportunity of forcibly opening the padlock to prevent unauthorized tampering and vandalism with respect to the padlock.

(2) Description Of The Prior Art

Conventional prior art security devices for shackles are either of relatively complex design so that the costs thereof are prohibitive, or of such simplistic design that the padlock, particularly the shackle, is exposed sufficiently so that it may be easily opened. The present invention utilizes a conventional padlock having a security shield permanently mounted with respect thereto. Thus, the security shield cannot be removed and misplaced or negligently not used by the user. While all locks are not "tamper-proof" the present invention provides a shield which prevents the shackle of the lock from being exposed when the lock is in a closed position and thus prevents tampering or vandalism.

Known prior art includes U.S. Pat. Nos. 3,783,657; 4,506,528; 2,541,638; 4,566,296; 4,567,740; 4,238,941; 4,122,693; and 3,828,591.

The advantages of this invention both as to its construction and mode of operation will be readily appreciated when the same becoms better understood with respect to the accompanying drawings in which like reference numerals indicate like parts throughout the figures.

BRIEF DESCRIPTIONS OF THE DRAWINGS

FIG. 1 is a perspective view of the security system with the padlock in a locked position;

FIG. 2 is a perspective view of the security system with the padlock in an unlocked position;

FIG. 3 is a rear perspective view of the security system of FIG. 2;

FIG. 4 is a perspective view of the security system of FIG. 1 after initial release of the shackle;

DESCRIPTION OF THE PREFERRED EMBODIMENT

Figure 5:
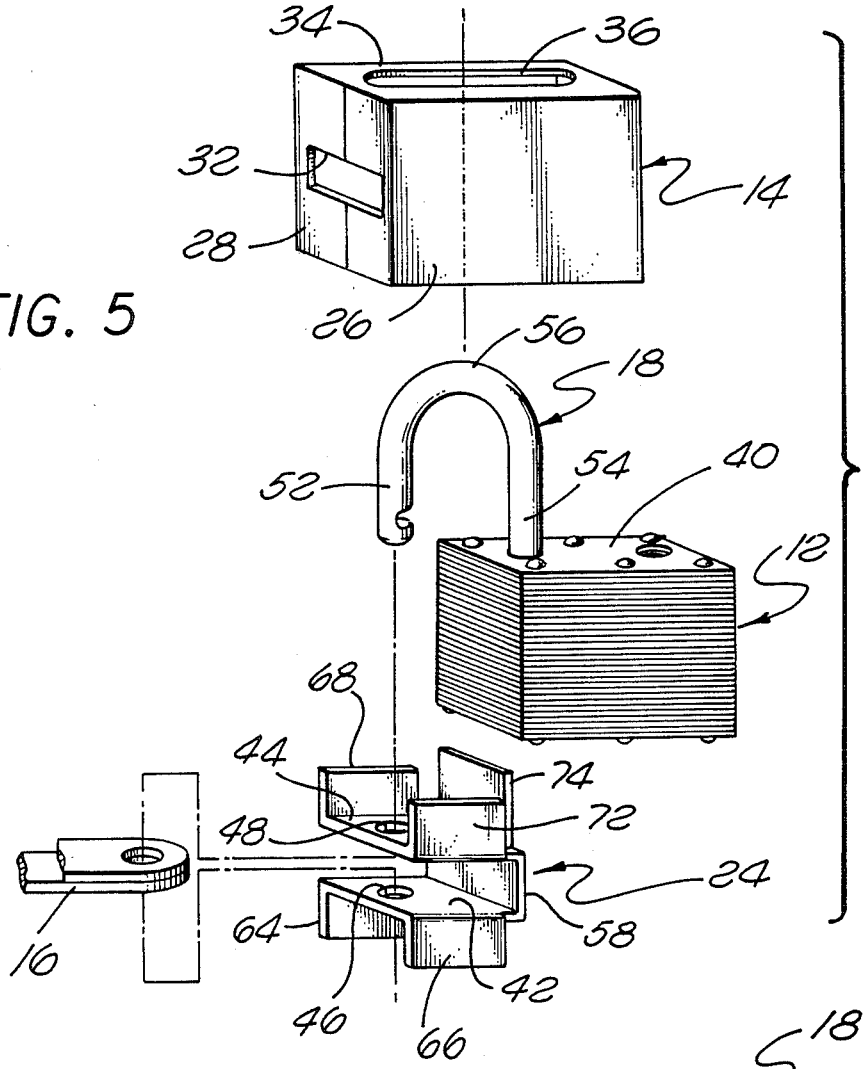
FIG. 5 is an exploded view of the security system.

Referring now to the drawings that is shown in FIG. 1, a conventional padlock 12 which is covered by a security shield including a housing 14. In the position shown in FIG. 1, the conventional hasp 16 is secured to the shackle 18 of the padlock. In the position shown in FIG. 2, a key 22 has been used to unlock the padlock 12 enabling the hasp 16 to be removed as the shackle 18 is moved to an upward position. As illustrated in FIG. 4, with the portion of the housing 14 cut-away, a saddle 24 is shown which is secured to the interior of the housing body.

In FIG. 5, the housing 14 includes a pair of identical side walls, one of the side walls 26 being shown, a front wall 28 containing a locking port slot 32 and a top wall 34 having a shackle exit slot 36. The housing rear wall 38 (FIG. 3) has a lower portion cutaway 39 enabling the padlock top surface 40 to be positioned therein when the padlock 12 is opened as illustrated in FIGS. 2 and 3.

The saddle 24 contains a pair of parallel members formed of a lower base 42 and a upper base 44 each having an aperture 46 and 48, respectively, formed therein for enabling the free leg 52 of the shackle 18 to pass therethrough. In this regard it should be noted that the padlock 12 is of the type having a pivoting captive leg 54 interconnected to the free leg 52 by means of a outer end 56. The bracket 24 prevents vertical movement of the padlock 12 in the vertical upward direction with respect to the housing 14 when the padlock is in a locked position.

A vertical arm 58 of the saddle 24 is used to interconnect the lower base 42 to the upper base 44. To connect the saddle 24 to the housing 14, a pair of ears 64 and 66 extend downwardly from the ends of the lower base 42 and are juxtaposed at their outer surfaces adjacent the inner surface of the housing 14 side walls 26. These juxtaposed surfaces are normally welded together securing the housing 14 to the saddle 24. A pair of spacers 68 and 72, respectively, extend upwardly from each end of the upper base 44 and are used to correctly position the saddle 24 within the interior of the housing 14. The height of these spaces 68 and 72 are normally chosen so that they abut the interior surface of the housing top wall 34. Alternatively, detents (not shown) could be formed in the outer surface of the spacers 68 and 72 for correctly positioning the saddle 24 with respect to the interior surface of the housing 14. The bottom surface of lower base 42 is also used to position the shackle with respect to the housing when the padlock is in the closed position. In the closed position of FIG. 1 and FIG. 6 the bottom surface of the lower base 42 abuts the top surface 40 of the padlock and prevents upward movement of the shackle through the exit slot 30. As illustrated in FIG. 4, when the shackle 18 is initially released vertical movement of the padlock is possible.

Figure 6:
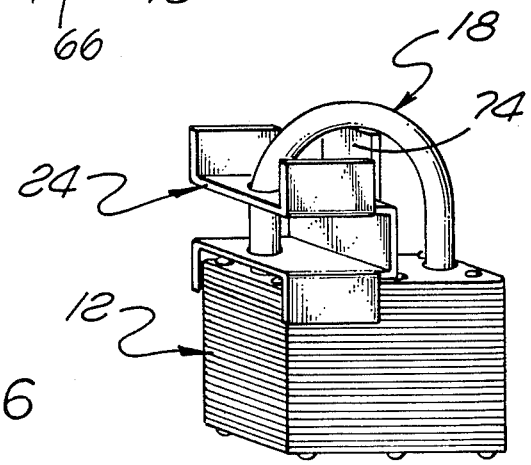
FIG. 6 is a view of the security system with the housing removed therefrom.

A support element 74 extends upwardly from the top surface of the upper base 44 in a plane generally parallel to the vertical arm 58. The height of the support element 74 is chosen so that it will be correctly position the shackle 18 in the housing 14 when the padlock is in a locked position as shown in FIG. 6 and prevents downward vertical movement of the padlock.

In operation, with the padlock 12 in a locked position as illustrated in FIG. 1, the shackle 18 and the adjacent portion of the lock body are covered so that it will be difficult to tamper therewith. When the padlock 12 is unlocked as shown in FIG. 4, the lock body then can move downwardly so that the lock body can rotate and clear the bottom surface of the housing 14. Then the lock body and shackle are moved upwardly in a vertical position to that shown in FIG. 3 so that the hasp 16 can be removed.

If the lock shackle were of the type which completely released at both ends as in a sliding shackle padlock, the rear wall 38 cutaway could be eliminated, as the lock body would not have to be rotated to the portion shown in FIG. 2 and 3 in order to release the hasp 16.

I claim:

1. A security shield for the protection of padlock of the type which has a body and a shackle, the shackle being of generally U-shaped configuration and having at least one free leg the security shield comprising:

a housing and a padlock positioned therein, said housing having a front and rear wall interconnected by a pair of side walls, a top wall interconnecting the ends of the front, rear and side walls to define an open ended box, said front wall having a locking port formed therein for enabling a hasp to pass therethrough, and an exit slot in said top wall for enabling said shackle outer end to pass therethrough;

a saddle secured to the interior said housing comprising a lower horizontal base and a upper horizontal base interconnected by an arm, said bases each having apertures therein for enabling the shackle free leg to pass therethrough and a shackle support element extending upwardly from said upper horizontal base for positioning said shackle with respect to said housing when said padlock is in a closed position, said housing enclosing said padlock shackle and the adjacent position of said padlock body when in a locked position.

2. A security shield in accordance with claim 1 wherein said lower horizontal bases abuts said padlock when said shackle is in a locked position.

3. A security shield in accordance with claim 1 wherein ears extend from said saddle for securing said saddle to said housing.

4. A security shield in accordance with claim 1 wherein a portion of said rear wall is removed for enabling said padlock housing top surface to be positioned therein when said padlock is unlocked.

* * * * *